US006004449A

United States Patent [19]

Vetrovec

[11] Patent Number: 6,004,449

[45] Date of Patent: Dec. 21, 1999

[54] METHOD OF OPERATING ELECTROLYTIC CELL TO PRODUCE HIGHLY CONCENTRATED ALKALINE HYDROGEN PEROXIDE

[75] Inventor: Jan Vetrovec, Agoura Hills, Calif.

[73] Assignee: Boeing North American, Inc., Seal Beach, Calif.

[21] Appl. No.: 09/021,061

[22] Filed: Feb. 9, 1998

[51] Int. Cl.[6] ..... C25B 1/30

[52] U.S. Cl. ..... 205/466; 205/468; 205/618

[58] Field of Search ..... 205/466, 468, 205/618

[56] References Cited

U.S. PATENT DOCUMENTS 4,969,981 11/1990 Rogers et al. ..... 204/84

*Primary Examiner*—Arun S. Phasge

*Attorney, Agent, or Firm*—Steven E. Kahm; Lawrence N. Ginsberg

[57] ABSTRACT

An alkaline peroxide cell for electrolytic regeneration of spent BHP from a chemical oxygen iodine laser, the cell having a for regenerating chlorine and a peroxide cell for regenerating BHP. The chlorine compartment having a potassium chloride electrolyte and producing chlorine gas for the chemical oxygen iodine laser. The peroxide cell having a spent BHP electrolyte and producing BHP for the chemical oxygen iodine laser. A cation exchange membrane between the chlorine compartment and the peroxide compartment allows potassium ions to be transported from the chlorine compartment to the peroxide compartment.

21 Claims, 2 Drawing Sheets

METHOD OF OPERATING ELECTROLYTIC CELL TO PRODUCE HIGHLY CONCENTRATED ALKALINE HYDROGEN PEROXIDE

BACKGROUND OF THE INVENTION

1. Field of the Invention

This invention relates to production and regeneration of concentrated basic (alkaline) hydrogen peroxide by electrosynthesis of water and oxygen in an aqueous solution of potassium hydroxide for the purpose of operating a chemical oxygen-iodine laser.

2. Description of the Related Art

Chemical oxygen-iodine laser (COIL) derives its power from continuous reaction of basic (alkaline) hydrogen peroxide and chlorine to produce electronically excited oxygen known as singlet delta oxygen $O_2(^1\Delta)$ via reaction $$Cl_2+2O_2H^-(aq)+2K_+\rightarrow H_2O_2+2KCl+O_2(^1\Delta) \quad (1)$$

The singlet delta oxygen is then used to excite iodine atoms to a laser transition. The applicant's co-pending patent application, Ser. No. 09/020,996, filed on Feb. 9, 1998 now abandoned, which is hereby made a part hereof and incorporated herein by reference, teaches how COIL can be operated in conjunction with an electrochemical cell which regenerates products of the basic hydrogen peroxide reaction with chlorine into fresh basic hydrogen peroxide and chlorine reactants. The process uses a porous, packed bed, self-draining, gas diffusion cathode to generate basic hydrogen peroxide by reduction of oxygen in alkaline electrolyte.

Cathodic reduction of oxygen for production of hydrogen peroxide according to the process:

$$O_2(g)+2H_2O+2e^-\rightarrow O_2H^-(aq)+OH^-(aq) \quad (2)$$

has been known since the 19th century. However, commercialization of the process has been retarded by several factors related to the complex electrochemistry of oxygen reduction, together with poor understanding of the influence of electrode materials and cell design on process efficiency. Prospects for commercial utilization of the alkaline hydrogen peroxide produced by this reaction as a bleaching agent in the pulp and paper industry motivated the research and development in the last two decades. During that period a number of patents have been awarded for process design, electrode design, configuration of the cell and method of operation.

Hydrogen peroxide generally used in bleaching is in the form of a stabilized alkaline solution of low peroxide concentration, typically 2 to 5% by weight. For economical reasons the alkali metal used is sodium. The relative molar concentration of NaOH to peroxide $H_2O_2$ in the bleach solution is generally between 1.0 and 2.0.

Cells with packed bed electrodes are known for Oloman et al U.S. Pat. Nos. 3,969,201 and 4,118,305. Improvements in these cells have been disclosed by McIntyre et al in U.S. Pat. Nos. 4,406,758; 4,431,494; 4,445,986; 4,511,441; and 4,457,953. Packed bed cathodes constructed from graphite chips coated with carbon black and polytetrafluorethylene as a binder have been found particularly suitable for the reduction of oxygen to alkaline hydrogen peroxide. Graphite is a good electrocatalyst, since it is electrically conductive, inexpensive, and requires no special treatment. The hydrophobic nature of the composite chips helps to prevent the cathode from becoming flooded by electrolyte. Moreover, composite chips have an improved capability to handle the flow of electric current in a packed bed. This both prolongs cathode bed life and improves its performance. A method for manufacture such composite particles has been disclosed by McIntyre in U.S. Pat. No. 4,457,953.

Dong in the U.S. Pat. No. 4,891,107 and U.S. Pat. No. 4,921,587 and Mathur in the U.S. Pat. No. 4,927,509 teach that a packed bed, self-draining cathode for maximum productivity within an electrochemical cell for the production of hydrogen peroxide in a solution of sodium hydroxide must be supplied with a liquid anolyte through a porous diaphragm at a substantially uniform rate of flow across the porous diaphragm without appreciable variation of the flow as a function of the head of the electrolyte. Said diaphragm can also be used to control the flow rate of electrolyte into the porous, packed bed cathode so as to avoid flooding the cathode or starving it of electrolyte.

The innovations disclosed by McIntyre, Dong and Mathur, listed above, have been recently utilized by Dow Chemical Company for a construction and operation of a pilot plant for commercial production of solution of hydrogen peroxide and sodium hydroxide intended for use as a bleach in the pulp and paper industry. This plant which is located at Fort Saskatchewan, Alberta, Canada has a capacity of 0.5 ton of $H_2O_2$ per day and has been operated continuously for several years. A larger plant with a capacity of 3.5 of $H_2O_2$ ton per day plant was built by Dow and installed at the Fort Howard Corporation mill in Muskogee, Okla.

Design attributes and method of operation of the Dow's alkaline peroxide cell are disclosed in the U.S. Pat. No. 4,927,509. At ambient temperature, with a feedstock of 4% by weight (1 mol/liter) of NaOH in water, and current density of approximately 0.3 amperes/in2, the Dow's cell produces alkaline hydrogen peroxide with approximately 4–5% $H_2O_2$ concentrations by weight at 80–85% current efficiency. At these concentrations and with the $NaOH/H_2O_2$ molar ratio between 1.4 and 1.8 the Dow's cell product is suitable for use as a bleach in the Kraft paper making process. An alternate process used by the pulp & paper industry known as the mechanical pulp process requires a bleach solution with reduced alkalinity. Suitable de-alkalinizer cells which could post-process the output of Dow's cell have been disclosed by Clifford et al in U.S. Pat. No. 5,106,464 and U.S. Pat. No. 5,244,547, and Paleologou et al in U.S. Pat. No. 5,006,211.

Methods for direct production of low alkalinity $H_2O_2$ in aqueous solution of NaOH in multi-compartment cells have been disclosed by Kuehn et al in U.S. Pat. No. 4,357,217 and Jasinski et al in U.S. Pat. No. 4,384,931. Both Kuehn and Jasinski claim to produce moderate concentrations of about 8% $H_2O_2$ in a low alkalinity solution. However, this result was accomplished at the expense of a high cell voltage (3–7 V), a low current density (0.25 amperes/in$^2$) and limited current efficiency making the process economically unattractive. The apparent source of problem with Kuehn's and Jasinski's cells was a poor performance of their gas diffusion cathode. Most recently, Dong et al, in the U.S. Pat. No. 5,643,437 discloses a method for co-generation of ammonium persulfate anodically and alkaline hydrogen peroxide cathodically with a cathode product ratio control. While this method can produce a lower alkalinity hydrogen peroxide in 5–6% concentration by weight, operating parameters of the cell, namely the high potential of 5 volt and low current density of 0.1 ampere/in$^2$ together with low current efficiency of 47% make this process less attractive.

In summary, all of the above processes for manufacturing of basic hydrogen peroxide used sodium cations in the electrolyte and produced only low concentrations of $H_2O_2$, typically less than 5% concentration by weight, all operate only at low current densities of typically less than 0.3 amperes/in$^2$ and, with the exception of Dow's process, all suffered of low current efficiency.

In order to make the electrosynthesis of $H_2O_2$ cost competitive with respect to the traditional methods of $H_2O_2$ production such as anthraquinone method, the prior art considered the use of NaOH rather than KOH in the cathode electrolyte. However, the use of NaOH makes the cathode susceptible to formation of $Na_2O_2$. $8H_2O$ (octohydrate) precipitate which gradually plugs the cathode pores (see Jan Balej, Application of Phase Diagram of the System NaOH—$H_2O_2$—$H_2O$ for the production of Hydrogen peroxide by Cathodic Reduction of Oxygen in Sodium Hydroxide Solutions, collection of Czechoslovak Chemical Communications, vol. 37, p 2830, 1972). Certain advantages of using KOH in peroxide production by electro-reduction of oxygen were observed in early prior art and disclosed by Berl in the U.S. Pat. No. 2,000,815. Berl claimed to have produced peroxide concentration of 5% by weight but at low current density of 0.3 amperes/in2 and with low efficiency of 66%. In another experiment, Berl's cell generated a product of containing a 18% by weight $H_2O_2$ and 38% by weight KOH at unspecified, but assumingly low current efficiency.

The basic hydrogen peroxide used in COIL (Chemical Oxygen-Iodine Laser) is an aqueous electrolyte containing hydrogen peroxide, potassium hydroxide, and often also potassium chloride. Experience shows that the basic hydrogen peroxide composition can significantly influence the efficiency and, therefore, the power output of the COIL. In particular, basic hydrogen peroxide with concentrations of $H_2O_2$ and KOH each below 2 mols per liter result in excessive quenching of the excited singlet oxygen in the basic hydrogen electrolyte. Similarly, basic hydrogen peroxide with molar ratio of KOH with respect to $H_2O_2$ in excess of 1.0 would contain a population of $OH^-$ anions which feeds a parasitic reaction between chlorine and $OH^-$ which does not produce the excited singlet delta oxygen. In either case the supply of the energetic singlet oxygen to the laser is reduced which has the consequential effect of reducing laser power. Furthermore, in order to maintain economical operation, the cell which regenerates basic hydrogen peroxide for the COIL should have a high current efficiency and low voltage. A regeneration cell with high current density is favored as it renders itself to a smaller hardware package. In order to avoid thermal decomposition of hydrogen peroxide the regeneration cell should operate at low temperature, preferably in the vicinity of 0° Centigrade. This is particularly important as no stabilizers can be added to the BHP due to a potential interference with the singlet delta producing reaction. Finally, the singlet delta oxygen producing reaction in Equation 1, above, also consumes chlorine. It is, therefore, desirable for some configurations of the chemical oxygen-iodine laser to combine production of basic hydrogen peroxide and chlorine into one electrolytic cell.

In summary, a suitable electrolytic cell for production of basic hydrogen peroxide by electro-reduction of oxygen for a COIL should 1) produce at least 10% $H_2O_2$ by weight and 11% KOH by weight, preferably in a molar ratio of not exceeding 1.0; 2) have a current efficiency at least 85%; 3) have a current density of at least 0.6 ampere/in$^2$; 4) be capable of operating at near 0° Centigrade, and 5) allow incorporation of chlorine generating anode into the cell. Methods disclosed in the prior art cannot meet all of these requirements simultaneously. A new electrosynthesis process, one specific for the needs of generating basic hydrogen peroxide for the chemical oxygen-iodine laser, is required.

SUMMARY OF THE INVENTION

The electrochemical cell of the invention and a method of operating said cell are particularly suited for the production of an aqueous alkaline hydrogen peroxide for use in the chemical oxygen-iodine laser. The electrochemical cell employs a porous, packed bed, self-draining, gas diffusion cathode which has means for receiving oxygen or a gas carrying oxygen, a means for receiving liquid electrolyte, and means for draining the electrolyte. The electrolyte flows into the gas diffusion cathode through a single or multiple layer separator-type diaphragm which is liquid permeable. Such a diaphragm may comprise a plurality of layers of a microporous film to provide substantially uniform electrolyte flow through said diaphragm into said porous, self-draining cathode. The packed bed is preferably comprised of composite graphite chips coated with carbon black using polytetrafluorethylene as a binding agent. The cathode is operated with an aqueous solution of potassium hydroxide, an aqueous solution of potassium hydroxide and hydrogen peroxide, or an aqueous solution of potassium hydroxide, hydrogen peroxide and potassium chloride. Numerous regeneration cell configurations can be constructed with said cathode generating basic hydrogen peroxide by electro-reduction of oxygen. The electrochemical cell and the process for operating said cell provide increased peroxide concentration and increased current density by simultaneously flowing into said porous gas diffusion electrode said electrolyte and a reactive gas.

In one embodiment said cathode is in a cell where the anode is supplied with aqueous solution of potassium hydroxide which flows toward and into the cathode and is enriched with basic hydrogen peroxide produced therein.

In another embodiment said cathode is in a cathode compartment of a two compartment cell with the compartment separator being a cation exchange membrane. The cathode is being supplied in the above described fashion with an aqueous solution of hydrogen peroxide, potassium hydroxide and potassium chloride for the purpose of reinforcing the hydrogen peroxide and potassium hydroxide concentrations therein. Concurrently, the anode compartment is being supplied with an aqueous solution of potassium chloride of low pH and chlorine gas is anodically produced. Potassium cations are transported from anolyte through the said cation exchange membrane into the catholyte. This embodiment is particularly suitable for regeneration of spent basic hydrogen peroxide and potassium chloride solution into fresh basic hydrogen peroxide and chlorine gas, said regeneration being for the purpose of continuously operating the chemical oxygen-iodine laser. In another mode of operation, said cell can be operated with an anolyte of aqueous solution of a suitable acid. In this process, gaseous oxygen is produced anodically and $H^+$ cations are transported through the cation exchange membrane into the cathode compartment to react with the catholyte and reduce its alkalinity.

In yet another embodiment, said cathode is in a cathode compartment of a three compartment cell with the compartment separators being an anion cation exchange membrane and a cation exchange membrane. The cathode is being supplied in above described fashion with an aqueous solution of potassium hydroxide for the purpose of generating hydrogen peroxide and potassium hydroxide and passing the pehydroxyl and hydroxyl anoins through the anion exchange membrane into the middle compartment of the cell. Concurrently, the anode compartment is being supplied with an aqueous solution of suitable acid for the purpose of anodically generating oxygen gas and passing hydrogen cations through said cation exchange membrane into the middle compartment, while the middle compartment of the cell is being supplied with feedstock liquor of an aqueous solution of hydrogen peroxide, potassium hydroxide and potassium chloride. The electrochemical process thus generates hydrogen peroxide $H_2O_2$ in the middle compartment liquor without increasing alkalinity of the said liquor. This embodiment is particularly suitable for increasing strength of $H_2O_2$ in basic hydrogen peroxide for use in the chemical oxygen-iodine laser.

OBJECTS OF THE INVENTION

It is an object of the invention to produce BHP by electro-reduction of oxygen in aqueous solution of potassium hydroxide.

It is an object of the invention to regenerate spent BHP from a chemical oxygen-iodine laser for reuse in the laser.

It is an object of the invention to produce BHP by electro-reduction of oxygen in concentrations suitable for use in a chemical oxygen-iodine laser.

It is an object of the invention to lower the cost of operation of a chemical oxygen iodine laser by regeneration of spent BHP.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
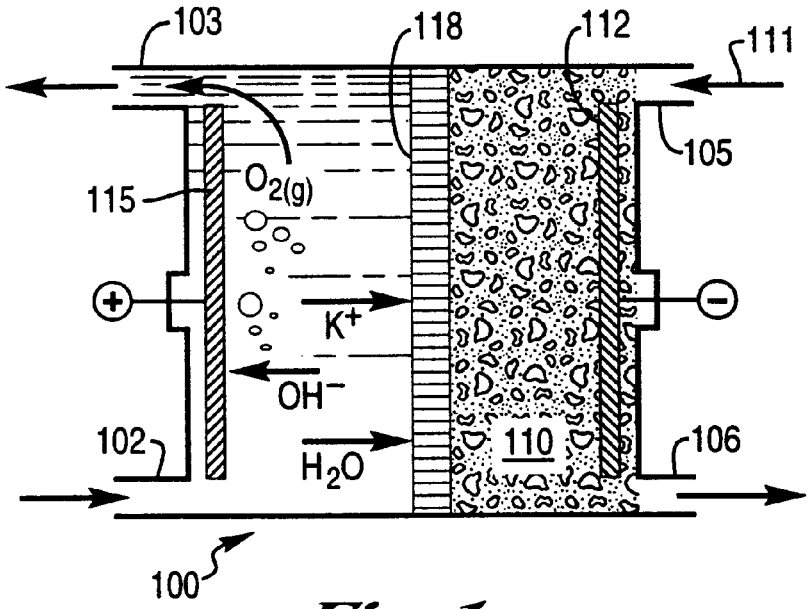
FIG. 1 shows a cell for production of basic hydrogen peroxide by cathodic reduction of oxygen.

The electrochemical cells shown and a method of operating said cells are particularly suited for the production of an aqueous alkaline hydrogen peroxide for use in the chemical oxygen-iodine laser. In said cells a porous, packed bed, self-draining, gas diffusion cathode is used. In one embodiment, FIG. 1, the cell 100 is arranged so that a cathode 110 and an anode 115 are separated by a single or multiple separator or diaphragm-type separator 118 which is liquid permeable and has a porosity of about 38% to about 45%, with an effective pore size of about 0.02 to about 0.04 micrometers. Feed liquor consisting of an aqueous solution of potassium hydroxide is allowed to enter the cell in the proximity of the anode 115 through the inlet port 102. Said electrolyte undergoes anodic reaction $$2K^+ + 2OH^-(aq) \rightarrow \tfrac{1}{2}O_{2(g)} + H_2O + 2K^+ + 2e^- \quad (3)$$

which produces water and gaseous oxygen. Gaseous oxygen is swept by the stream of said electrolyte and is removed through the outlet port 103. A portion of the anolyte liquor and $K^+$ cations are allowed to flow into the cathode 110 though the liquid permeable diaphragm 118. Said diaphragm is positioned against the cathode 110 or its support so as to be in a physical contact with the cathode 110, thereby allowing liquids to flow through the diaphragm 118 flow directly into the cathode packed bed 110. The diaphragm 118 may be supported by the electrode 110, or it may be supported by another element, or it may be self supporting. The diaphragm 118 is preferably composed of a plurality of layers of a microporous film or a composite, preferably of the polyolefin type, to provide substantially uniform electrolyte flow through said diaphragm into said porous, packed bed, self-draining cathode 110 without substantial variation of the flow as a function of the head of the electrolyte inside the cell 100. Suitable porous material for construction of the diaphragm 118 consists of a 1 mil thick polyolefin film laminated to a non-woven polypropylene fabric with a total thickness of 5 mils. Such porous material composites are available under the trade designation CELGARD® from Celanese Corporation. The film or composite diaphragm is characterized as hydrophilic, having been treated with a wetting agent in preparation thereof. U.S. Pat. Nos. 4,891,107 and 4,921,587 disclose that by utilizing multiple layers of this material to construct the diaphragm 118 it is possible to obtain desirable flow rates for efficient operation of the cell.

The cathode 110 is preferably an electrically conductive porous mass having a plurality of pores therethrough. It may be a bed of electroconductive sintered particles or an agglomeration of loose particles. It must have pores of sufficient size to allow both liquid and gas to flow therethrough. The size of the pores must be sufficient to allow electrolyte flow by gravity to the lower portion of the cathode 110, i.e. the cathode should be self-draining. The porous, packed bed, self-draining cathode 110 of the invention generally has a thickness of about 1 to 2.5 centimeters in the direction of the flow. In the preferred configuration, the packed bed contains composite graphite particles coated with carbon and polytetrafluorethylene as a binder as disclosed in U.S. Pat. No. 4,457,953. Said cathode 110 constructed in this fashion is electrically conductive and is in contact with and supported by the liquid permeable diaphragm 118. The opposite side of said cathode is in contact with a current distributor 112 which may be fabricated of either solid or perforated sheet metal, preferably of high purity nickel. During operation of the cell, an oxygen, or oxygen carrying gas 111 enters the cell through a gas inlet 105 and is fed to the non-electrolyte active portion of the porous, packed bed, self-draining, gas diffusion cathode 110. Said gas flows through the pores of the cathode 110 where it comes to a contact with the electrolyte which is simultaneously controllably flowed to the cathode 110 through the diaphragm 118 at a flow rate equal to the drainage rate of the cathode. The flow rate through the diaphragm 118 is determined by the differential pressure across said diaphragm, such that said electrolyte flowrate through said diaphragm is about 0.04 to about 0.80 milliliters per minute per square inch of diaphragm area. The electrochemical reaction $$O_{2(g)} + H_2O + 2e^- \rightarrow O_2H^-_{(aq)} + OH^-_{(aq)} \quad (4)$$

occurring within the cathode 110 reduces oxygen to peroxyl and hydroxyl anions, i.e. basic hydrogen peroxide. At least a portion of the oxygen gas provided to the cathode is consumed in said reaction. The basic hydrogen peroxide product liquor flows by gravity with 3–12 inches hydraulic head, said head measured from the top of said electrolyte in the cell to the lower portion of the cathode 110 and is drained through the outlet port 106. For proper operation of the cell it is necessary to maintain a delicate pressure balance of feed gas 111 and electrolyte pressures so that electrolyte only partially wets the porous packed bed cathode 110. In another words, said balance of pressures is to assure that the porous cathode 110 is neither flooded with liquid nor excessively dry. Preferably, the cell is operated in the temperature range of about minus 5° Centigrade to about +25 degrees Centigrade.

The hydrogen peroxide product at the outlet port 106 generally contains 12% or more by weight (3.5 mol/liter) of hydrogen peroxide with a $KOH/H_2O_2$ molar ratio less than 1.3. Prior to use in the chemical oxygen-iodine laser such product liquor may be de-alkanized to desired level either by addition of HCl acid or by processing it in a suitable de-alkalinizer cell such as those disclosed in the U.S. Pat. Nos. 5,006,211; 5,106,464; and 5,244,547.

Figure 2:
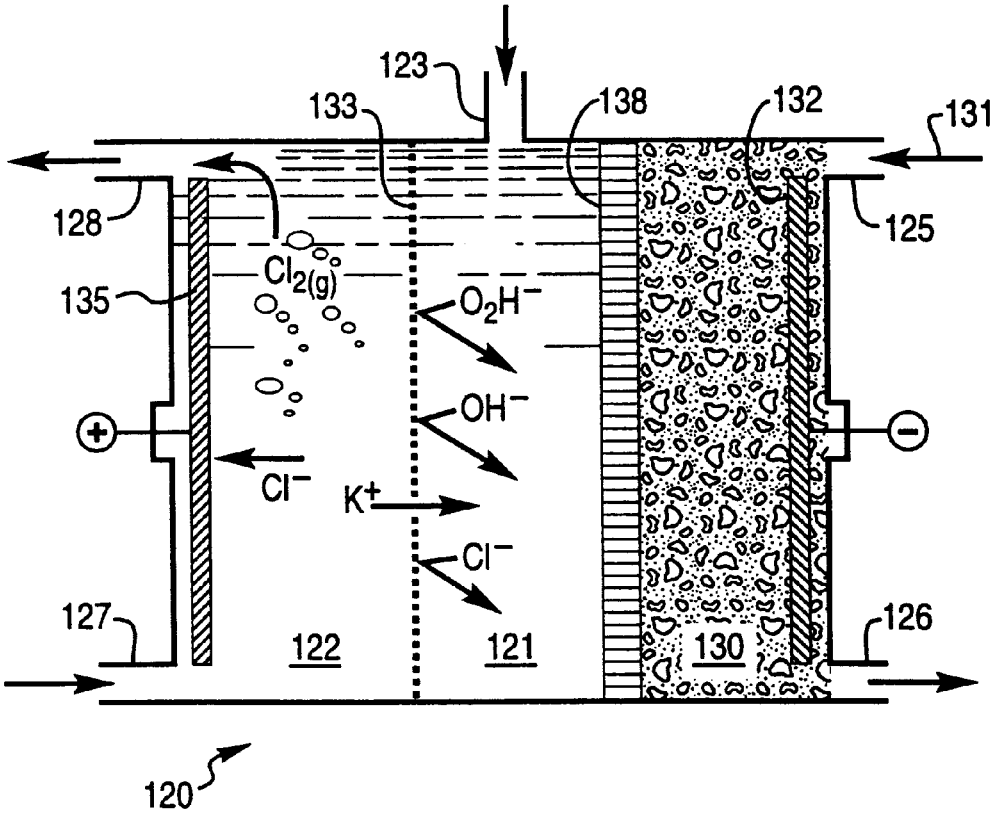
FIG. 2 shows a two compartment cell for simultaneous production of basic hydrogen peroxide by cathodic reduction of oxygen and anodic production of chlorine.

Another embodiment of the invention is shown in FIG. 2. The electrochemical cell 120 has two compartments 121 and 122 separated by a cation exchange membrane 133. The cathode compartment 121 employs a porous, packed bed, self-draining cathode 130 for electrosynthesis of $O_2H^-$ and $OH^-$ by reduction of oxygen in alkaline electrolyte. A liquid permeable diaphragm 138 is positioned against the cathode 130 for its support. The cathode 130 and the diaphragm 138 are of the same type and style of construction as those used in the embodiment of the invention shown in FIG. 1. It should be understood that the size of the particles in the packed bed and the number of layers of the diaphragm may be adjusted to accommodate changed viscosity of the electrolyte in order to achieve optimum performance. Cathode feed liquor, fed in at inlet 123, is an aqueous solution of hydrogen peroxide, potassium hydroxide, and potassium chloride. The concentrations of each of the ingredients may vary over a wide range but typically are about 3 mol/liter of $O_2H^-$, up to 2 mol/liter of un-ionized $H_2O_2$, up to 3.5 mol/liter of $OH^-$, and with potassium chloride up to saturation. The cathode feed liquor is provided through inlet 123 into the cathode compartment 121 into the space between the cation exchange membrane 133 and the diaphragm 138. Diaphragm 138 is liquid permeable allowing the electrolyte to flow in a controlled fashion into the porous, packed bed, self-draining cathode 130. Simultaneously, oxygen, or oxygen carrying gas 131 is fed through inlet 125 to the cathode 130. At least a portion of the oxygen presented to the cathode undergoes a reduction to $O_2H^-$ and $OH^-$ anions according to Equation 4. If the cathode feedstock does not contain $OH^-$ anions but contains unionized $H_2O_2$, the later will be ionized by reacting with the $OH^-$ anion to produce another $O_2H^-$ anion and a water molecule according to $$OH^-_{(aq)}+H_2O_2 \rightarrow O_2H^-+H_2O \quad (5)$$

Alternately, if the cathode feed liquor fed in at inlet 123 does not contain $H_2O_2$, the $OH^-$ anion generated in the reaction of Equation 3 adds to the concentration of $OH^-$ anions in the feedstock. In either case, the liquor drained from the cathode 130 through the outlet 126 has an increased concentration of $O_2H^-$ anions and increased alkalinity over that of the cathode feedstock liquor.

The anolyte of the electrolytic cell 120 is an aqueous solution of KCl with sufficiently low pH to prevent anodic production of potassium chlorate. The anolyte liquor is fed into the anode compartment 122 through the inlet port 127 and is electrolyzed on the anode 135 as.

$$2Cl^-_{(aq)}-2e^- \rightarrow Cl_{2(g)} \quad (6)$$

Preferably, the chlorine gas generated on said anode is entrained in the anolyte flow and transported from anode compartment 122 through anolyte outlet 128 to a gas-liquid separator. Anolyte largely free of entrained chlorine gas and enriched with KCl is returned through feed port 127 back to the anode compartment 122. Alternately, chlorine gas can be separated from the anolyte liquor in the upper portion of the anode compartment 122 and removed through a separate outlet port as is well know to those skilled in the art.

During electrolysis, potassium cations $K^+$ are transported from the anolyte through the cation exchange membrane 133 into the catholyte. At the same time the cation exchange membrane 133 blocks the transport of $OH^-$ and $O_2H^-$ anions from the cathode feed liquor into the anolyte. The cation exchange membrane 133 may be of the perfluorinated type such as the Nafion® family (Nafion is a registered trademark of DuPont Company). The preferred membrane is the Nafion(® 430 which is particularly suitable for use in cells for electrolysis of KCl. The anode 135 can be made either of solid graphite or can be of the corrosion resistant type commonly used in commercial chlor-alkali cells. Such corrosion resistant anodes are typically made of titanium and are coated with a suitable chlorine evolution catalyst. This type of corrosion resistant anode is known in the industry as the Dimensionally Stable Anode or DSA® (DSA is a registered trademark of Diamond Shamrock Technologies S.A.)

In order to prevent thermal decomposition of basic hydrogen peroxide both the anolyte and catholyte are operated at a temperature near 0 degrees Centigrade. Consequential penalty in ohmic loses caused by the low temperature operation is more than offset by the economical benefits of generating basic hydrogen peroxide and chlorine in the same cell. Basic hydrogen peroxide and chlorine produced by the cell 120 depicted in FIG. 2 may be directly used in the chemical oxygen-iodine laser. Should it be desirable to reduce the alkalinity of the basic hydrogen peroxide, HCl acid can be added to the output liquor of the cell, or said output can be processed in a suitable dealkalinizer cell in an earlier described fashion.

As an alternative to using an aqueous solution of KCl as the anolyte liquor feed, the electrolytic cell 120 can be operated with a suitable acidic aqueous electrolyte, preferably $H_2SO_4$. In this mode of operation, electrolysis of the anolyte splits the water molecules and oxygen gas is evolved on the anode according to the reaction $$H_2O \rightarrow \tfrac{1}{2}O_2+2H^+_{(aq)}+2e^- \quad (7)$$

The $H^+$ cations are transported by the electric field of the cell from the anode compartment 122 through the cation exchange membrane 133 into the cathode compartment 121. The cathode feed liquor introduced at the inlet 123 is a alkaline electrolyte of the same composition as previously described. After migrating across the cation exchange membrane 133, the $H^+$ cations react with the $O_2H^-$ and $OH^-$ anions of the catholyte in the following ways $$H^+_{(aq)}+O_2H^-_{(aq)} \rightarrow H_2O_2 \quad (8)$$

$$H^+_{(aq)}+OH^-_{(aq)} \rightarrow H_2O \quad (9)$$

Both of these processes reduce the alkalinity of the cathode feedstock liquor. Using this technique and, by carefully balancing the flow rates and electric current of the cell, alkalinity of the feedstock liquor can be reduced to any desirable level. It should be noted, however, that it is undesirable to reduce the alkalinity of said feedstock much below 2 mol/liter of KOH because low alkalinity feedstock adversely affects operation of the cathode. It should be also noted the that operation of the cell 120 in above described mode will have the following net effects on the cathode feedstock liquor: 1) two molecules of $H_2O_2$ are added per two electron charge passed through the cell, and 2) there is no net change in alkalinity between the feedstock liquor at the inlet 123 and the cathode outlet 126. This is a fundamentally different result from the previously described mode of operation with KCl brine anolyte where the net effect on the cathode liquor was increased in alkalinity by addition of one $O_2H^-$ anion and one $OH^-$ anion per two electron charge passed through the cell.

Figure 3:
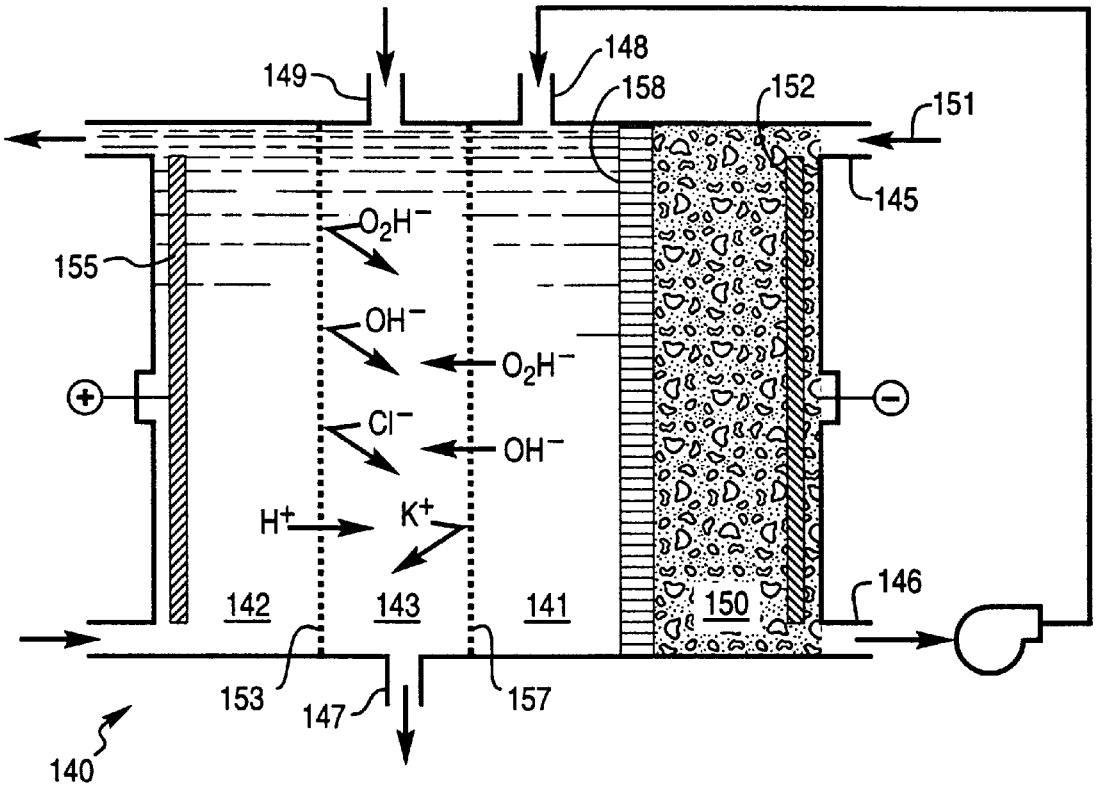
FIG. 3 shows a three compartment cell for production of basic hydrogen peroxide with low alkalinity.

Yet another embodiment of the invention is shown in FIG. 3. The electrochemical cell 140 has three compartments 141, 142 and 143 separated by a cation exchange membrane 153 and a anion exchange membrane 157. The cathode compartment 141 employs a porous, packed bed, self-draining cathode 150 with a liquid permeable diaphragm 158 in a configuration suitable for electrosynthesis of $O_2H^-$ and $OH^-$ by reduction of oxygen in alkaline electrolyte. The cathode 150 and the diaphragm 158 are of same type and style of construction as those used in the embodiment of the invention shown in FIG. 1. Cathode feed liquor of aqueous solution of hydrogen peroxide and potassium hydroxide is provided through inlet 148 to the cathode compartment 141 into the space between the anion exchange membrane 157 and the diaphragm 158. Said diaphragm is liquid permeable, allowing the electrolyte to flow in a controlled fashion into the porous, packed bed, self-draining cathode 150. Simultaneously, oxygen, or oxygen carrying gas 151 is fed through inlet 145 to the cathode 150. At least a portion of the oxygen presented to the cathode undergoes a reduction to $O_2H^-$ and $OH^-$ anions according to Equation 4 (above). Liquor drained from the cathode outlet 146 contains increased concentration of $O_2H^-$ and $OH^-$ anions over the liquor entering the cathode 150 through the diaphragm 158.

The anode compartment 142 contains acidic aqueous electrolyte, preferably $H_2SO_4$. Electrolysis of the anolyte splits the water molecules and causes anodic evolution of oxygen gas according to the reaction in Equation 7. The $H^+$ cations are transported by the electric field of the cell from the anode compartment 142 through the cation exchange membrane 153 into the central compartment 143. Same electric field also facilitates transport of $O_2H^-_{(aq)}$ and $OH^-_{(aq)}$ anions from the cathode compartment 141 through the anion exchange membrane 157 into the middle compartment 143. Said middle compartment receives its feedstock liquor through inlet 149. Said feedstock liquor is an aqueous solution of hydrogen peroxide, potassium hydroxide, and potassium chloride. The $H^+$ cations react with the $O_2H^-$(aq) and $OH^-$(aq) anions in the middle compartment according to Equations 8 and 9 to produce $H_2O$ and peroxide $H_2O_2$. As a net result the liquor leaving the middle compartment 143 through outlet 147 is enriched with $H_2O_2$ and $H_2O$ over the feedstock liquor at the inlet 149. Alkalinity of said liquor remains unaffected by this process.

In certain modes of operation the chemical oxygen-iodine laser requires a longer term storage of the basic hydrogen peroxide. However, thermal decomposition of peroxide the peroxide (either $H_2O_2$ or $O_2H^-$) during periods of such storage severely limits the shelf life of basic hydrogen peroxide. This embodiment of the invention is particularly useful for reprocessing of basic hydrogen peroxide that has been degraded by thermal decomposition of peroxide.

An experiment with an electrolytic cell 100 was conducted in accordance with the schematic diagram shown in FIG. 1. The cell diaphragm 118 was composed of three layers of a porous material composite available under the trade name CELGARD® from the Celanese Corporation with each layer comprising of 1 mil thick microporous polyolefin film laminated to a non-woven polypropylene fabric so as to provide a total laminated thickness of 5 mils. The anode 115 utilized in the cell was made of nickel plated stainless steel. The cathode 110 was of the packed bed type and composed of the composite graphite chips with carbon coating and polytetrafluorethylene as binding agent. An aqueous solution of KOH with concentration of 2 mol/liter (about 11.4% by weight) was fed into the cell anode area. The temperature of the laboratory setup during the experiment was on the average about 23° C. A potential was applied to the cell and adjusted so as to achieve a cathode current density of 1.0 amperes/in$^2$ which was reached at approximately 2 volts. The cell was operated under these conditions for a total of 4,335 minutes, i.e. approximately 72 hours, and consistently generated basic hydrogen peroxide of 12% concentration by weight (i.e. 3.55 mol/liter) at a current efficiency of at least 87%. The table below shows the detail data.

| Time (minutes) | $H_2O_2$ in Product (grams/liter) | $H_2O_2$ in Product (mol/liter) | KOH/$H_2O_2$ molar ratio | Current Efficiency (%) |
|---|---|---|---|---|
| 1053 | 122.6 | 3.61 | 1.333 | 88.9 |
| 1430 | 123.5 | 3.63 | 1.316 | 88.6 |
| 2475 | 119.8 | 3.52 | 1.327 | 86.9 |
| 2880 | 120.6 | 3.55 | 1.296 | 87.5 |
| 3920 | 120.8 | 3.55 | 1.333 | 87.6 |
| 4335 | 120.8 | 3.55 | 1.338 | 90.4 |

U.S. Pat. Nos. 4,927,509 and 4,969,981 are hereby attached hereto and made a part hereof by reference to show a method and a process of making basic hydrogen peroxide which may be useful in understanding this patent application.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A process for the manufacture of an aqueous solution of basic hydrogen peroxide by cathodic reduction of oxygen in the presence of alkaline electrolyte in an electrolytic cell; said cell comprising an anode; a liquid permeable diaphragm; and a porous, packed bed, self-draining cathode;

wherein said cathode is in contact with a current distributor on one face of said cathode and is in contact with said liquid permeable diaphragm on an opposite face of said cathode;

wherein said cathode comprises a bed of sintered particles or an agglomeration of loose particles and said cathode has pores of sufficient size and number to allow both gas and liquid to flow therethrough;

wherein said particles are graphite chips coated with a mixture of carbon black and polytetrafluorethylene;

wherein said pores form pasageways having minimum diameter of 30 to 50 microns;

wherein said current distributor is made of high purity nickel or suitable nickel alloy;

wherein said liquid permeable diaphragm comprises 2 to about 5 layers of (A) a microporous polyolefin film or (B) a composite comprising said microporous polyolefin film and a support fabric resistant to deterioration upon exposure to electrolyte and electrolysis products thereof;

wherein said microporous polyolefin film of the liquid permeable diaphragm is characterized as hydrophilic and having porosity of about 38% to about 45%, an effective pore size of about 0.02 to about 0.04 micrometers, and a thickness of about 1 mil;

wherein said electrolyte flowed into the cathode is a an aqueous solution of potassium hydroxide with a concentration of at least 1.5 mol/liter;

wherein said electrolyte is supplied to the said cathode with 3–10 inches hydraulic head, said head measured from the top of said electrolyte in the cell;

wherein the cathode has means to receive gas reactant;

wherein said gas flowed into said cathode is oxygen or is an oxygen carrying gas;

wherein said said process comprising:

(A) flowing said electrolyte between said anode and said diaphragm;

(B) electrolytically reacting said electrolyte to generate oxygen gas on said anode surface;

(C) allowing said oxygen gas generated on said anode to be removed by the flow of said electrolyte flowing past said anode;

(D) allowing portion of the said electrolyte flowed in proximity of said anode to flow through said liquid permeable diaphragm into said cathode;

(E) flowing oxygen into a portion of said self-draining cathode;

(F) controllably flowing a liquid electrolyte through said liquid permeable diaphragm into a portion of said porous, packed bed, self-draining cathode at a rate about equal to the drainage of the cathode, such that said electrolyte flowrate through said diaphragm is about 0.04 to about 0.80 mililiters per minute per square inch of diaphragm area;

(G) electrolytically reacting said liquid electrolyte within said cathode with said gas to form peroxyl and hydroxyl anions in said electrolyte;

(H) removing the products of electrolysis from said self-draining cathode;

(I) drawing an electric current between said anode and said cathode with the current density on said cathode being at least 0.6 amperes per square inch;

(J) maintaining the temperature of said cell and said electrolyte in the range of about −5 degrees Centigrade to about +25 degrees Centigrade.

2. An electrochemical cell for simultaneous manufacture of an aqueous solution of basic hydrogen peroxide and chlorine gas; said basic hydrogen peroxide being produced by cathodic reduction of oxygen in the presence of alkaline electrolyte and said chlorine gas being produced by electrolysis of acidic aqueous solution of alkali metal chloride, said cell comprising:

an anode;

a cation exchange membrane;

a liquid permeable diaphragm; and a porous, packed bed, self-draining cathode;

wherein said cation exchange membrane is located between said anode and said cathode;

wherein said liquid permeable diaphragm is in contact with the surface of said cathode facing said membrane;

a means for introducing cathode feed electrolyte into the space between said cation exchange and diaphragm;

wherein said cathode electrolyte is an aqueous solution of alkali metal hydroxide, hydrogen peroxide, and said alkali metal chloride;

a means for flowing said cathode feed electrolyte into said cathode through said diaphragm;

a means for introducing oxygen or oxygen carrying gas into said cathode on the surface opposite to the surface facing said diaphragm;

a means for draining processed electrolyte from the cathode;

wherein the electrolyte drained from the cathode is an aqueous solution of alkali metal hydroxide, hydrogen peroxide, and said alkali metal chloride with increased concentrations of said alkali metal hydroxide and hydrogen peroxide over their respective concentrations in said cathode feed electrolyte;

a means for recirculating an acidic solution of said alkali metal chloride through the space between said anode and said cation exchange membrane.

3. The electrochemical cell of claim 2 wherein said anode is made of graphite.

4. The electrochemical cell of claim 2 wherein said anode is a Dimentionally Stable Anode.

5. The electrochemical cell of claim 2 wherein, said cathode comprises a bed of sintered particles or an agglomeration of loose particles and said cathode has pores of sufficient size and number to allow both gas and liquid to flow therethrough;

wherein said particles are graphite chips coated with a mixture of carbon black and polytetrafluorethylene;

wherein said pores form pasageways having minimum diameter of about 30 to about 50 microns;

wherein said cathode is in a contact with a current distributor on one face of said cathode and is in contact with said liquid permeable diaphragm on an opposite face of said cathode;

wherein said liquid permeable diaphragm comprises 2 to about 5 layers of a material selected from the group comprising a microporous polyolefin film and a composite comprising said microporous polyolefin film and a support fabric resistant to deterioration upon exposure to electrolyte and electrolysis products thereof;

wherein said microporous polyolefin film of the liquid permeable diaphragm is chartacterized as hydrophilic and having porosity of about 38% to about 45%, an effective pore size of about 0.02 to about 0.04 micrometers, and a thickness of about 1 mil;

wherein said current distributor is made of high purity nickel or suitable nickel alloy.

6. The electrochemical cell of claim 5 wherein said cathode feed electrolyte is an aqueous solution of a mixture of potassium hydroxide, hydrogen peroxide, and potassium chloride and wherein the anode feed electrolyte is an acidic aqueous solution of potassium chloride.

7. The electrochemical cell of claim 5 wherein said cathode feed electrolyte is an aqueous solution of a mixture of sodium hydroxide, hydrogen peroxide, and sodium chloride and wherein the anode feed electrolyte is an acidic aqueous solution of sodium chloride.

8. A process for the simultaneous manufacture of an aqueous solution of basic hydrogen peroxide and chlorine gas; said basic hydrogen peroxide being produced by cathodic reduction of oxygen in the presence of alkaline electrolyte and said chlorine gas being produced by electrolysis of acidic aqueous electrolyte of alkali metal chloride; said cell comprising an anode;

a cation exchange membrane;

a liquid permeable diaphragm; and, a porous, packed bed, self-draining cathode;

wherein said alkaline electrolyte flowed into the cathode is a an aqueous solution of basic hydrogen peroxide comprising a mixture alkali metal hydroxide, hydrogen peroxide and alkali metal chloride;

wherein said alkaline electrolyte is supplied to the said cathode with about 3–12 inches hydraulic head, said head measured from the top of said basic hydrogen peroxide electrolyte in the cell;

wherein the cathode has means to receive gas reactant;

wherein said gas flowed into said cathode is oxygen or is an oxygen carrying gas;

wherein said process comprising:

(A) flowing said acidic electrolyte between said anode and said diaphragm; electrolytically reacting said acidic electrolyte to generate chlorine gas on said anode surface;

(B) allowing said chlorine gas generated on said anode to be removed by the flow of said electrolyte flowing past said anode;

(C) flowing oxygen into a portion of said self-draining cathode;

(D) introducing said alkaline electrolyte into the space between said cation exchange membrane and said liquid permeable diaphragm;

(E) controllably flowing said alkaline electrolyte through said liquid permeable diaphragm into a portion of said porous, packed bed, self-draining cathode at a rate about equal to the drainage of said cathode wherein, said electrolyte flowrate through said diaphragm is about 0.04 to about 0.80 mililiters per minute per square inch of diaphragm area;

(F) electrolytically reacting said alkaline electrolyte within said cathode with said oxygen or oxygen carrying gas to form peroxyl and hydroxyl anions in said alkaline electrolyte;

(G) removing the products of electrolysis from said self-draining cathode (J) drawing an electric current between said anode and said cathode with current density on said cathode being at least 0.6 amperes per square inch;

(H) maintaining the temperature of said cell and said electrolytes anywhere in the range of about −5 degrees Centigrade to about +25 degrees Centigrade.

9. The electrochemical process of claim 8 wherein said alkaline electrolyte is an aqueous solution of a mixture of potassium hydroxide, hydrogen peroxide, and potassium chloride and wherein said acidic electrolyte is an aqueous solution of potassium chloride.

10. The electrochemical process of claim 8 wherein said alkaline electrolyte is an aqueous solution of a mixture of sodium hydroxide, hydrogen peroxide, and sodium chloride and wherein said acidic electrolyte is an aqueous solution of sodium chloride.

11. An electrochemical cell for enriching of aqueous alkaline electrolyte with hydrogen peroxide; said hydrogen peroxide being produced by cathodic reduction of oxygen in the presence of alkaline electrolyte; said cell comprising;

an anode;

a cation exchange membrane;

a liquid permeable diaphragm; and a porous, packed bed, self-draining cathode;

wherein said aqueous alkaline electrolyte is an aqueous solution of potassium hydroxide, hydrogen peroxide, and potassium chloride;

wherein said cation exchange membrane is located between said anode and said cathode;

wherein said liquid permeable diaphragm is in contact with the surface of said cathode facing said membrane;

a means for introducing cathode feed electrolyte into the space between said cation exchange and diaphragm;

a means to flow said cathode feed electrolyte into said cathode through said diaphragm;

a means for introducing oxygen or oxygen carrying gas into said cathode on the surface opposite to the surface facing said diaphragm;

a means for drain processed electrolyte from the cathode;

wherein the electrolyte drained from the cathode is an aqueous solution of potassium hydroxide, hydrogen peroxide and potassium chloride with increased concentration of said hydrogen peroxide over its concentration in said cathode feed electrolyte;

a means for recirculating an aqueous solution of sulfuric acid through the space between said anode and said cation exchange membrane.

12. The electrochemical cell of claim 11 wherein said anode is made of graphite.

13. The electrochemical cell of claim 11 wherein said anode is a Dimentionally Stable Anode.

14. The electrochemical cell of claim 11 wherein said cathode comprises:

a bed of sintered particles or an agglomeration of loose particles and said cathode has pores of sufficient size and number to allow both gas and liquid to flow therethrough; wherein said particles are graphite chips coated with a mixture of carbon black and polytetrafluorethylene;

wherein said pores form pasageways having minimum diameter of 30 to 50 microns;

wherein said cathode is in a contact with a current distributor on one face of said cathode and is in contact with said liquid permeable diaphragm on an opposite face of said cathode;

wherein said liquid permeable diaphragm comprises 2 to about 5 layers of a material selected from the group of a microporous polyolefin film and a composite comprising said microporous polyolefin film and a support fabric resistant to deterioration upon exposure to electrolyte and electrolysis products thereof;

wherein said microporous polyolefin film of the liquid permeable diaphragm is chartacterized as hydrophilic and having porosity of about 38% to about 45%, an effective pore size of about 0.02 to about 0.04 micrometers, and a thickness of about 1 mil;

wherein said current distributor is made of high purity nickel or suitable nickel alloy.

15. A process for processing of aqueous solution of basic hydrogen peroxide; said processing involving addition of hydrogen peroxide; said hydrogen peroxide being produced by cathodic reduction of oxygen in the presence of alkaline; said cell comprising:

an anode;

a cation exchange membrane;

a liquid permeable diaphragm; and, a porous, packed bed, self-draining cathode;

wherein said alkaline electrolyte flowed into the cathode is a an aqueous solution of basic hydrogen peroxide comprising a mixture alkali metal hydroxide, hydrogen peroxide and alkali metal chloride;

wherein said alkaline electrolyte is supplied to the said cathode with about 3–12 inches hydraulic head, said head measured from the top of said basic hydrogen peroxide electrolyte in the cell;

wherein the cathode has means to receive gas reactant;

wherein said gas flowed into said cathode is oxygen or is an oxygen carrying gas;

wherein said process comprising:

(A) flowing said acidic electrolyte between said anode and said diaphragm; electrolytically reacting said acidic electrolyte to generate chlorine gas on said anode surface;

(B) allowing said chlorine gas generated on said anode to be removed by the flow of said electrolyte flowing past said anode;

(C) flowing oxygen into a portion of said self-draining cathode;

(D) introducing said alkaline electrolyte into the space between said cation exchange membrane and said liquid permeable diaphragm;

(E) passing $H^+$ cations from said acidic electrolyte through said cation exchange membrane into said alkaline electrolyte in the space between said cation exchange membrane and said liquid permeable diaphragm;

(F) reacting said $H^+$ cations with said alkaline electrolyte to reduce alkalinity of said electrolyte prior to entry of said electrolyte into said cathode;

(G) controllably flowing said alkaline electrolyte through said liquid permeable diaphragm into a portion of said porous, packed bed, self-draining cathode at a rate about equal to the drainage of said cathode, said electrolyte flowrate through said diaphragm is about 0.04 to about 0.40 mililiters per minute per square inch of diaphragm area;

(H) electrolytically reacting said alkaline electrolyte within said cathode with said oxygen to form peroxyl and hydroxyl anions in said alkaline electrolyte;

(I) removing the products of electrolysis from said self-draining cathode;

(J) drawing an electric current between said anode and said cathode with current density on said cathode being at least 0.6 amperes per square inch;

(K) maintaining the temperature of said cell and said electrolytes anywhere in the range of about −5 degrees Centigrade to about +25 degrees Centigrade.

16. An electrochemical cell for enriching of aqueous alkaline electrolyte with hydrogen peroxide; said hydrogen peroxide being formed from $OH^-$ anions produced by cathodic reduction of oxygen in the presence of alkaline catholyte and $H^+$ cations drawn from acidic electrolyte; said cell comprising:

an anode;

an anion exchange membrane;

a cation exchange membrane;

a liquid permeable diaphragm; and, a porous, packed bed, self-draining cathode;

wherein said anion exchange membrane is located between said liquid permeable diaphragm and said cation exchange membrane;

wherein said cation exchange membrane is located between said anion exchange membrane and said anode;

wherein said liquid permeable diaphragm is in contact with the surface of said cathode facing said anion exchange membrane;

a means for introducing cathode feed electrolyte into the space between said anion exchange membrane and said liquid permeable diaphragm;

wherein said cathode electrolyte is an aqueous solution of potassium hydroxide and hydrogen peroxide;

a means to flow said cathode feed electrolyte into said cathode through said diaphragm;

a means to introduce oxygen or oxygen carrying gas into said cathode on the surface opposite to the surface facing said diaphragm;

a means to drain processed electrolyte from the cathode;

wherein the electrolyte drained from the cathode is an aqueous solution of potassium hydroxide and hydrogen peroxide with increased concentration of said of potassium hydroxide and said hydrogen peroxide over its concentration in said cathode feed electrolyte flowing through said diaphragm;

a means for recirculating said cathode electrolyte drained from said cathode back into the space between said anion exchange membrane and said liquid permeable diaphragm;

a means for flowing aqueous alkaline electrolyte through the space between said anion exchange membrane and said cation exchange membrane;

wherein there are means for recirculating an aqueous solution of sulfuric acid through the space between said anode and said anion exchange membrane.

17. The electrochemical cell of claim 16 wherein said anode is made of graphite.

18. The electrochemical cell of claim 16 wherein said anode is a Dimentionally Stable Anode.

19. The electrochemical cell of claim 16 wherein said cathode comprises:

a bed of sintered particles or an agglomeration of loose particles and said cathode has pores of sufficient size and number to allow both gas and liquid to flow therethrough; wherein said particles are graphite chips coated with a mixture of carbon black and polytetrafluorethylene;

wherein said pores form pasageways having minimum diameter of 30 to 50 microns;

wherein said cathode is in a contact with a current distributor on one face of said cathode and is in contact with said liquid permeable diaphragm on an opposite face of said cathode;

wherein said liquid permeable diaphragm comprises 2 to about 5 layers of a material selected from the group comprising a microporous polyolefin film and a composite comprising said microporous polyolefin film and a support fabric resistant to deterioration upon exposure to electrolyte and electrolysis products thereof;

wherein said microporous polyolefin film of the liquid permeable diaphragm is chartacterized as hydrophilic and having porosity of about 38% to about 45%, an effective pore size of about 0.02 to about 0.04 micrometers, and a thickness of about 1 mil;

wherein said current distributor is made of high purity nickel or suitable nickel alloy.

20. A process for enriching of aqueous alkaline electrolyte with hydrogen peroxide; said hydrogen peroxide being formed from $OH^-$ anions produced by cathodic reduction of oxygen in the presence of alkaline catholyte and $H^+$ cations drawn from acidic electrolyte; said cell comprising:

an anode;

an anion exchange membrane;

a cation exchange membrane;

a liquid permeable diaphragm; and, a porous, packed bed, self-draining cathode;

wherein said alkaline catholyte flowed into the cathode is a an aqueous solution of potassium hydroxide and hydrogen peroxide;

wherein said alkaline catholyte is supplied to the said cathode with about 3–12 inches hydraulic head, said head measured from the top of said catholyte in the cell;

wherein the cathode has means to receive oxygen or is an oxygen carrying gas;

wherein there are means for continuous recirculation of said catholyte;

wherein said acidic electrolyte is an aqueous solution of sulphuric acid;

wherein there are means for continuous recirculation of said acidic electrolyte; wherein said process comprising:

(A) flowing said acidic electrolyte between said anode and said cation exchange membrane;

(B) electrolytically reacting said acidic electrolyte to generate oxygen gas on said anode surface;

(C) allowing said oxygen gas generated on said anode to be removed by the flow of said electrolyte flowing past said anode;

(D) passing $H^+$ cations from said acidic electrolyte through said cation exchange membrane into said aqueous alkaline electrolyte in the space between said cation exchange membrane and said anion exchange membrane;

(E) flowing oxygen into a portion of said self-draining cathode;

(F) introducing said alkaline catholyte into the space between said anion exchange membrane and said liquid permeable diaphragm;

(G) flowing aqueous alkaline electrolyte through the space between said anion exchange membrane and cation exchange membrane;

(H) controllably flowing said alkaline electrolyte through said liquid permeable diaphragm into a portion of said porous, packed bed, self-draining cathode at a rate about equal to the drainage of said cathode, said electrolyte flowrate through said diaphragm is about 0.04 to about 0.40 mililiters per minute per square inch of diaphragm area;

(I) electrolytically reacting said alkaline electrolyte within said cathode with said oxygen or oxygen carrying gas to form peroxyl and hydroxyl anions in said alkaline electrolyte;

(J) removing said catholyte with the products of electrolysis from said self-draining cathode;

(K) returning said catholyte drained from the cathode back into the space between said anion exchange membrane and said liquid permeable diaphragm;

(L) passing $OH^-$ and $O2H^-$ anions from within said catholyte in the space between said anion exchange membrane and said liquid permeable diaphragm through said anion exchange membrane into the space between said anion exchange membrane and said cation exchange membrane;

(M) reacting said $H^+$ cations with said OH— and O2H— anions within said alkaline electrolyte in the space between said anion exchange membrane and said cation exchange membrane to form hydrogen peroxide and to reduce alkalinity thereof according to $H+(aq)+O2H^-(aq)\rightarrow H_2O_2$ and $H^+(aq)+OH^-(aq)\rightarrow H_2O$ (N) drawing an electric current between said anode and said cathode with current density on said cathode being at least 0.6 amperes per square inch;

(O) maintaining the temperature of said cell and said electrolytes anywhere in the range of about −5 degrees Centigrade to about +25 degrees Centigrade.

21. A process of claim 20 wherein said alkaline electrolyte in the space between said anion exchange membrane and said cation exchange membrane is an aqueous solution of potassium hydroxide, hydrogen peroxide, and potassium chloride.

* * * * *